US006769837B1

(12) United States Patent
Ross

(10) Patent No.: US 6,769,837 B1
(45) Date of Patent: Aug. 3, 2004

(54) MONOLITHIC ASPHALT SURFACE WITH SHIELDING EDGES

(76) Inventor: Guy Ross, 9 Antares Dr., Ottawa, Ontario (CA), K2E 7V5

( * ) Notice: Subject to any disclaimer, the term of this patent is extended or adjusted under 35 U.S.C. 154(b) by 0 days.

(21) Appl. No.: 10/453,482

(22) Filed: Jun. 4, 2003

(51) Int. Cl.[7] ..... E01C 7/00
(52) U.S. Cl. ..... 404/75
(58) Field of Search ..... 404/27, 31, 72, 404/75

(56) References Cited

U.S. PATENT DOCUMENTS

| | | | | | |
|---|---|---|---|---|---|
| 393,568 | A | * | 11/1888 | MacKnight | 404/72 |
| 1,410,733 | A | * | 3/1922 | Cary | 404/75 |
| 1,670,346 | A | * | 5/1928 | Finley | 404/75 |
| 4,329,083 | A | * | 5/1982 | Parkinson | 405/184.5 |
| 4,815,891 | A | * | 3/1989 | O'Connor | 404/77 |
| 5,026,206 | A | * | 6/1991 | O'Connor | 404/77 |
| 5,406,663 | A | | 4/1995 | Chen | |
| 5,921,707 | A | * | 7/1999 | Owen | 404/75 |
| 6,074,128 | A | * | 6/2000 | Marino | 404/75 |

* cited by examiner

*Primary Examiner*—Gary S. Hartmann
(74) *Attorney, Agent, or Firm*—Ronald G. Bitner

(57) ABSTRACT

A method of forming a shielded asphalt surface on a prepared subgrade for a roadway, or the like, to prevent water infiltration, freeze-thaw cycles, and roots from damaging the surface. The method involves forming a recess along the outer edges of the subgrade; depositing asphalt into the recess and compacting the deposited asphalt to form an edge portion at about the same height as the subgrade; depositing asphalt onto the subgrade to form the roadway surface and also onto the edge portion; compacting the deposited asphalt thereby integrating the asphalt that forms the roadway surface with the asphalt that forms the edge portion to provide a monolithic shielded asphalt surface.

7 Claims, 2 Drawing Sheets

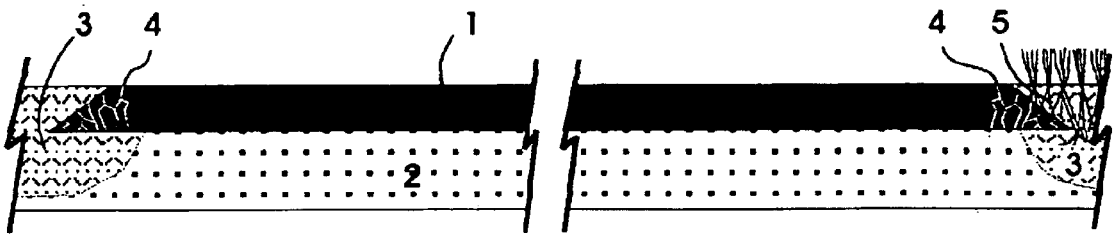
Fig.1-Prior Art
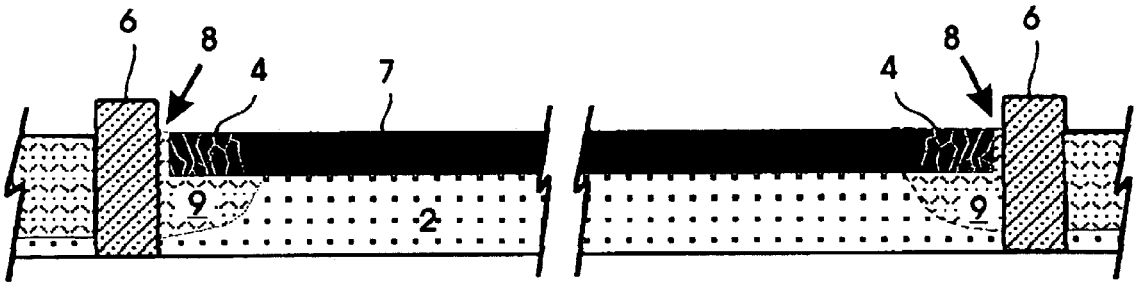
Fig.2-Prior Art
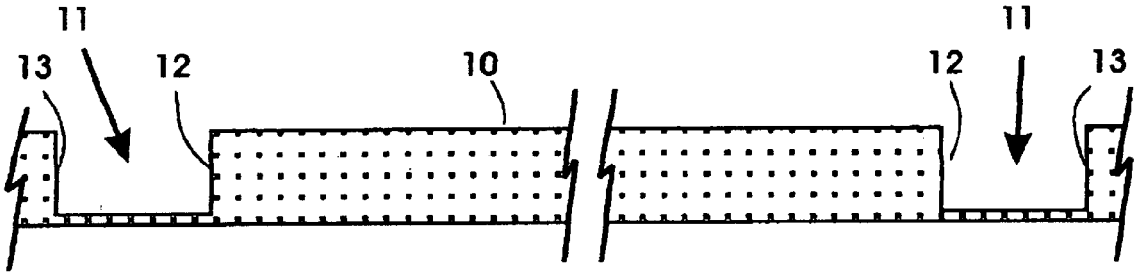
Fig.3

MONOLITHIC ASPHALT SURFACE WITH SHIELDING EDGES

FIELD OF THE INVENTION

This invention relates to an asphalt surface for a roadway, or the like, that incorporates integrated edge portions that provide a shield against water and/or plant roots.

BACKGROUND OF THE INVENTION

A problem encountered with asphalt driveways, roadways, and the like, is the intrusion by water or plant roots along the edge of the asphalt. In winter, water that has found its way under the asphalt at the edges freezes, and freeze-thaw cycles cause shifting and cracking of the asphalt surface. In summer, roots from grass and/or trees, may grow under the edge and cause uplifting and damage to the edges of the asphalt surface. Curbs commonly used along the edges of streets usually do not prevent the problem since it is difficult to maintain a good seal between the curb and asphalt roadway, and eventually water will find its way under the edges of the roadway causing the above-mentioned problems with freezing and possibly also plant roots The use of the term "asphalt" as used herein refers to a mixture of a bituminous binder and aggregate as is commonly used for roadway surfacing.

SUMMARY OF THE INVENTION

An object of the present invention to provide shielding edges for asphalt surfaces to alleviate the problems associated with water and/or plant root intrusion.

It has been found that the problems caused by water or roots under the edges of an asphalt surface can be alleviated by providing a shielding edge portion that is integral with, and extends below the asphalt surface to prevent the intrusion of water and roots.

The present invention provides a method of forming a shielded asphalt surface on a prepared subgrade, comprising: forming a recess along the outer edge of the subgrade; depositing asphalt into said recess and compacting the deposited asphalt to form an edge portion at substantially the same height as the subgrade; depositing asphalt onto the subgrade, to form a roadway surface, and onto the edge portion; and compacting the deposited asphalt thereby integrating the asphalt that forms the roadway surface with the asphalt that forms the edge portion to provide a monolithic shielded asphalt surface.

BRIEF DESCRIPTION OF THE DRAWINGS

FIG. 1 is a cross-sectional schematic representation of prior art showing a typical asphalt surfaced roadway.

FIG. 2 is a cross-sectional schematic representation of prior art showing an asphalt surfaced roadway with curbs.

FIGS. 3 to 7 are cross-sectional schematic representations showing the steps for an embodiment of the present invention:

FIG. 3 shows the roadway subgrade provided with recesses at the outer edges.

FIG. 4 shows asphalt deposited in the recesses shown in FIG. 3.

FIG. 5 shows a cross-section of the deposited asphalt of FIG. 4 after compaction.

FIG. 6 shows asphalt for the roadway deposited onto the subgrade and prepared edge portions as shown in FIG. 5.

FIG. 7 shows the roadway of FIG. 6 after compaction and completion.

DESCRIPTION OF THE PREFERRED EMBODIMENTS

Figure 4:
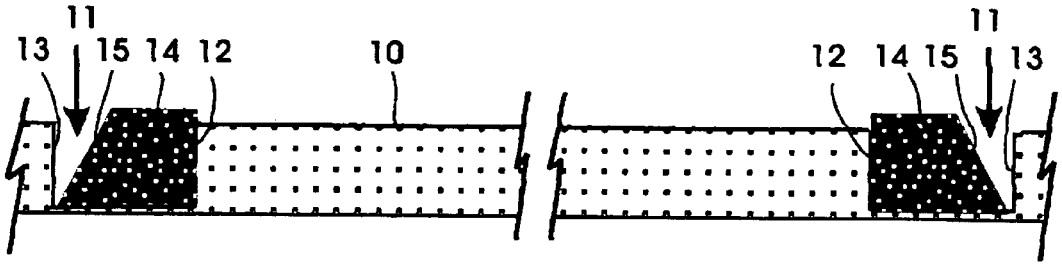

FIG. 1 is a schematic representation of prior art showing a typical asphalt surfaced roadway. It can be seen that water 3 can readily infiltrate under the asphalt surface 1 and into the subgrade 2 and with repeated freeze-thaw cycles produces cracks 4. Also, plant roots 5 can readily grow under the asphalt and cause damage.

FIG. 2 is another schematic representation of prior art showing a roadway with curbs 6. It is difficult to maintain a water tight seal between the asphalt surface 7 and curb 6. With time, and particularly with temperature induced expansion and contraction, separation of the asphalt from the curb will occur whereby the opening 8 thus produced allows water 9 to infiltrate beneath the asphalt and cause damage from repeated freeze-thaw cycles.

With reference to FIGS. 3 to 7, the present invention involves providing an asphalt surface with edge portions integrated with the roadway surface to form a shield against water and root intrusion.

FIG. 3 shows a cross-section of a roadway with subgrade 10 prepared for surfacing. In accordance with the present invention, a recess 11 is formed at the outer edge of the subgrade 10. The recess 11 defines an inner wall 12 and outer wall 13 in the subgrade 10.

Referring to FIG. 4, asphalt 14 is placed into the recess 11 against the inner wall 12 of the subgrade 10 for providing a continuous base for subsequent surfacing, as will be described. Preferably the outer side 15 of the deposited asphalt will be sloped downwardly and outwardly towards the outer wall 13, as shown, to prevent subsequent crumbling of the outer edges.

Figure 5:
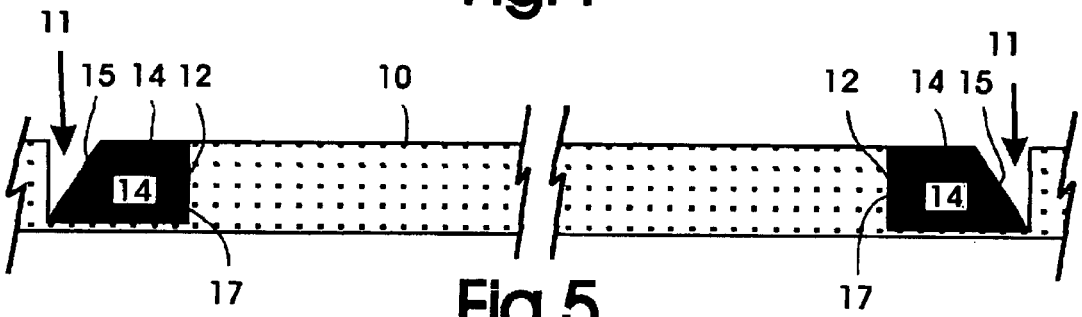

As shown in FIG. 5, the deposited asphalt 14 in recess 11 is then compacted such that the top surface of asphalt in the recess after compaction is approximately at the level of the subgrade 10 and against the inner wall 12 to provide a continuous and substantially level base for the roadway surface. The deposited and compacted asphalt 14 defines edge portions 17.

It will be appreciated that the subgrade and the top surface of the edge portion 17 may be slightly sloped for drainage.

If the depth of the recess 11 is greater than 5 inches, the asphalt should be compacted for each layer of about 5 inches to ensure adequate strength.

Figure 6:
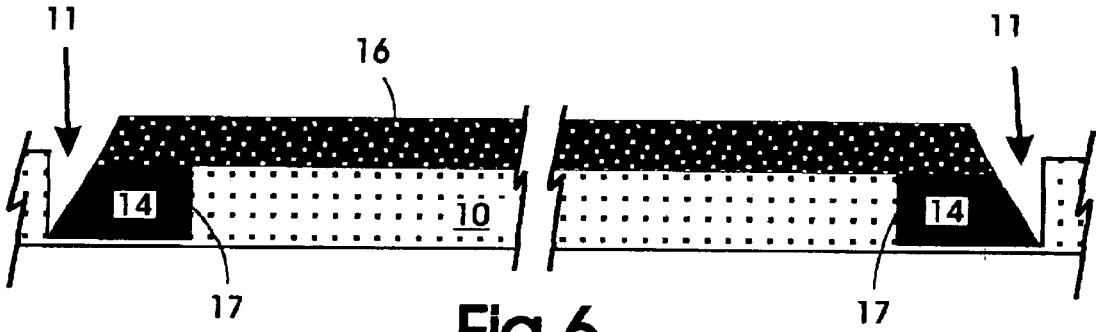

To surface the roadway, asphalt 16 is deposited onto the subgrade as well as onto the edge portions17, as shown in FIG. 6.

Figure 7:
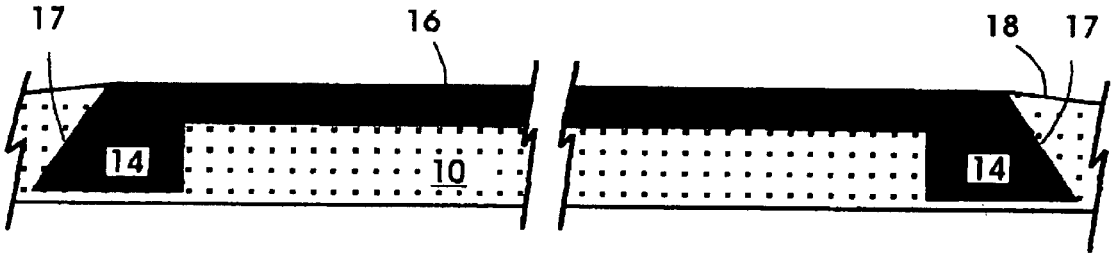

With reference to FIG. 7, the deposited asphalt 16 is then compacted thereby integrating the asphalt 16 that forms the roadway surface with the asphalt 14 that forms the edge portions 17. The compacted asphalt forms a monolithic structure whereby the edge portions 17 form a shield that sheds water reducing accumulation of water under the edges of the roadway. Keeping the subgrade under the asphalt surface dry reduces the likelihood of damage from frost and the intrusion of plant roots.

Preferably, the step of placing asphalt 16 on the main roadway will be preformed soon after the edge portions 17 are completed, and preferably while still hot, to facilitate the bonding and integration of the main roadway with the edge portions.

The sloping of the outer sides 15 of the edge portions prevents crumbling of the outer edges 15 of the asphalt, and also facilitates the shedding of water.

Following the final step of compaction of the asphalt surface 16, the non-filled outer region of the recess 11 may be filled with suitable fill material 18 as desired to provide an even surface away from the asphalt surface 16, as shown in FIG. 7.

The depth of the outer depending edge portion 17 will depend on the location and/or the conditions the roadway will be subjected to. For example, if the prevention of damage from roots is a concern, the presence of adjacent trees would dictate a deeper edge portion than grass. The range of suitable depths for the asphalt receiving recess 11, for various conditions, was found to be from about 3 to 18 inches.

For most roadways both sides will be provided with shielded edge portions. For some asphalt surfaces, such as a circular area, only one outer edge will be present to require a shielded edge.

What is claimed is:

1. A method of forming a shielded asphalt surface on a prepared subgrade, comprising;

forming a recess along the outer edge of the subgrade;

depositing asphalt into said recess and compacting the deposited asphalt to form an edge portion at substantially the same height as the subgrade;

depositing asphalt onto the subgrade, to form a roadway surface, and onto the edge portion; and compacting the deposited asphalt thereby integrating the asphalt that forms the roadway surface with the asphalt that forms the edge portion to provide a monolithic shielded asphalt surface.

2. The method of claim 1, wherein the recess defines an inner wall and outer wall in the subgrade, and the asphalt deposited in the recess is placed against the inner wall for providing a continuous subgrade base after compaction.

3. The method of claim 2 wherein an outer side of the deposited asphalt slopes downwardly towards the outer wall of the recess.

4. The method of claim 1, wherein the recess extends at least 3 inches below the subgrade.

5. The method of claim 1, including a compaction step for at least every 5 inches of asphalt placed in the recess.

6. The method of claim 1, wherein the asphalt deposited onto the subgrade for forming the roadway surface is placed after forming the edge portion to facilitate bonding therewith.

7. A monolithic shielded roadway surface produced by the method of claim 1.

* * * * *